US005080362A

United States Patent [19]

Lillard

[11] Patent Number: 5,080,362

[45] Date of Patent: Jan. 14, 1992

[54] ADJUSTABLE POINT OF IMPACT INDICATING DEVICE

[76] Inventor: Neil Lillard, 3442 W. Dartmouth Ave., Denver, Colo. 80236

[21] Appl. No.: 517,170

[22] Filed: May 1, 1990

[51] Int. Cl.[5] ..... A63B 49/00

[52] U.S. Cl. ..... 273/73 R; 273/184 R; 200/61.49; 200/61.51

[58] Field of Search ..... 273/73 R, 29 R, 29 A, 273/26 R, 26 B, 183 R, 183 D, 184 R, 186 C; 340/566, 683; 200/61.45, 61.48, 61.49, 61.51

[56] References Cited

U.S. PATENT DOCUMENTS

| | | | |
|---|---|---|---|
| 1,846,966 | 2/1932 | Hausse | 200/61.49 |
| 1,891,493 | 12/1932 | Apostoloff | 200/61.49 |
| 2,076,251 | 4/1937 | Rockola | 200/61.51 |
| 2,302,670 | 11/1942 | Buchanan | 200/61.51 |
| 2,311,637 | 2/1943 | Buchanan | 200/61.49 |
| 2,402,111 | 6/1946 | Engler | 200/61.49 |
| 2,407,122 | 9/1946 | Young | 200/61.49 |
| 2,986,937 | 6/1961 | Chapman | 73/379 |
| 3,122,365 | 2/1964 | August | 273/26 |
| 3,270,564 | 9/1966 | Evans | 73/432 |
| 3,318,602 | 5/1967 | Kunihisa | 273/162 |
| 3,380,305 | 4/1968 | Charell | 273/184 R |
| 3,436,076 | 4/1969 | Barthol | 273/26 |
| 3,436,676 | 4/1969 | Cook | 334/117 |
| 3,502,831 | 3/1970 | McRoskey | 273/61.49 |
| 3,538,756 | 11/1970 | Coombs | 73/91 |
| 3,683,353 | 8/1972 | Miller | 200/61.51 |
| 3,790,727 | 2/1974 | Laserson et al. | 200/61.51 |
| 3,896,426 | 7/1975 | Laurent | 200/61.51 |
| 4,222,562 | 9/1980 | Gardner | 273/67 R |
| 4,257,594 | 3/1981 | Conrey et al. | 273/29 A |
| 4,297,690 | 10/1951 | Baker | 200/61.49 |
| 4,311,891 | 1/1982 | Faust | 200/61.48 |
| 4,834,376 | 5/1989 | Steinberg | 273/26 B |

FOREIGN PATENT DOCUMENTS

| | | | |
|---|---|---|---|
| 3414467 | 1/1985 | Fed. Rep. of Germany | 273/29 A |
| 133879 | 10/1919 | United Kingdom | 273/73 R |
| 1216031 | 12/1970 | United Kingdom | 273/184 R |

*Primary Examiner*—Edward M. Coven
*Assistant Examiner*—William E. Stoll
*Attorney, Agent, or Firm*—Sheridan, Ross & McIntosh

[57] ABSTRACT

An impact sensing device (16) is attached to a sporting implement to provide a visual indication of when the implement strikes a sporting object. The device (16) comprises a cylinder (22) containing a flexible wire (40) encircled by contacts (50 and 51). Upon impact between the sporting implement and the sporting object, the wire (40) flexes and oscillates to connect with the contacts (50 and 51). A circuit is closed and an indicator (18) is initiated by a power source (34). The sensitivity of the device (16) may be adjusted with first and second adjustments (24 and 26) to change the relationship between the wire (40) and the contact (50).

20 Claims, 3 Drawing Sheets

FIG. 4
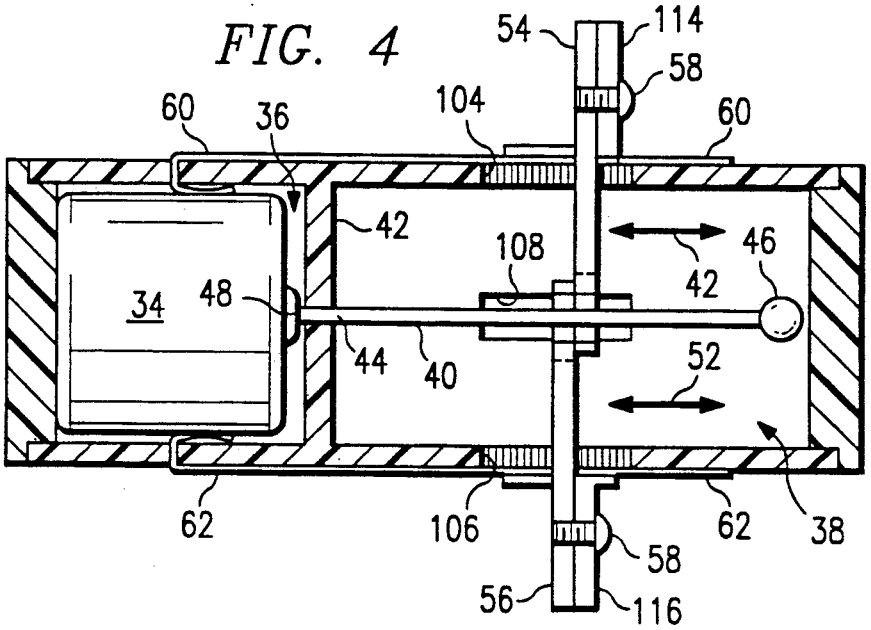
FIG. 5
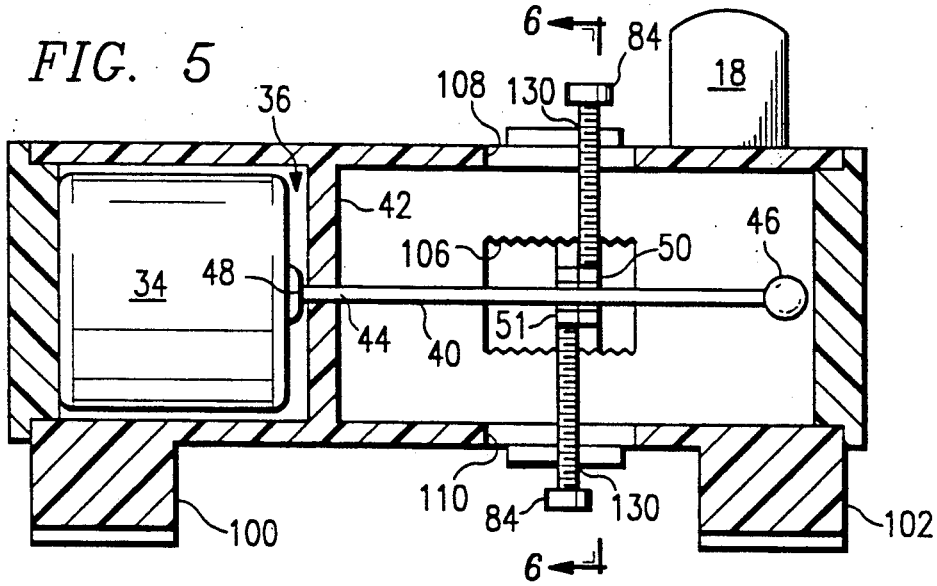
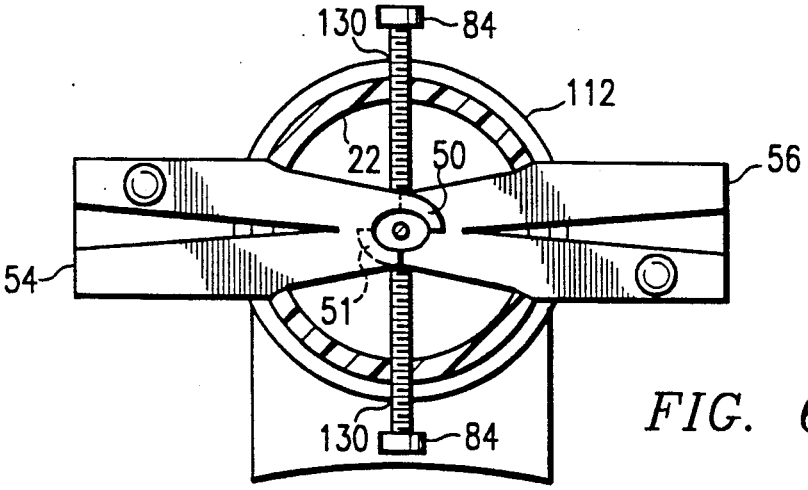
FIG. 6

ADJUSTABLE POINT OF IMPACT INDICATING DEVICE

BACKGROUND OF THE INVENTION

This invention relates in general to sport training aid devices, and in particular to an adjustable device for indicating the location of impact of a game object.

DESCRIPTION OF RELATED ART

In sports it is frequently important to know when, where and with how much force a game object comes into contact of an impact device. In tennis, for example, it is desirable for a player to know the location of impact of the tennis ball on the tennis racket, how much force is applied upon impact to the ball, and exactly where in the path of the swing that the racket and ball contact each other. Knowledge of these items will assist a tennis player to improve their game.

It is known to provide baseball bats and tennis rackets with impact sensing devices having certain attributes. For example, U.S. Pat. No. 3,380,305 to Charell discloses a device for sensing the force of impact between a baseball and a baseball bat. The Charell device transmits a signal upon impact of the bat and ball to an electronic circuit which is either external or internal to the bat. The signal indicates the amount of impact force between the bat and the ball, and this information is translated into a series of lights. The lights are turned on depending upon the amount of force upon impact, and the more lights that are lit, the greater the impact. The Charell device is not designed, however, to provide information to the batter as to where the ball strikes the bat, where in the swing impact occurs, and is not adjustable for sensitivity.

In U.S. Pa. No. 4,257,594 to Conrey, et al., a further impact sensing device is preferably installed in a tennis racket and will provide an audiovisual indication of where the tennis ball strikes the racket. Thus, the Conrey device will indicate to the tennis player whether the "sweet spot" on the racket has been hit or not. The Conrey device is very complex and does not provide the tennis player with information as to where in the stroke the ball is hit with the racket nor does it have any sensitivity adjustment. Thus, while the player will know whether the "sweet spot" has been hit, the player will not know whether the ball has been hit too early or too late in a stroke.

In U.S. Pat. No. 3,436,076 to Barthol, a training device for sports is disclosed. The Barthol device provides a visual signal to a player upon impact of a device with a ball. The Barthol device has no adjustability to account for various individuals or various strokes.

Since many sports are played by a wide variety of people (children, adults, males and females), it is extremely useful to provide an indicating device that is adjustable. Adjustability should be for various sports, various physical characteristics of the user and various types of swings. For example, in tennis it would be advantageous to be able to adjust sensitivity for a forehand stroke versus an overhead or backhand stroke, for a male versus a female player, for a young versus an old player and for a novice versus an experienced player. There is no such sensing device heretofore available and, thus, there is a need for a method and apparatus that provides information to an individual as to where a playing object, such as a ball, is struck by a sporting implement, such as a tennis racket, and is completely adjustable for sensitivity.

SUMMARY OF THE INVENTION

The present invention disclosed herein comprises a method and apparatus for visually training athletes which eliminates or greatly reduces problems associated with prior training devices. The present invention provides visual training for an athlete by allowing the athlete to see the point in a swing or stroke at which a sporting implement strikes a playing object and is adjustable for sensitivity.

In accordance with one aspect of the invention, a sensing device comprising a switch, an indicator and a sensitivity control for the switch is provided. The switch comprises a length of a flexible conductor and a contact at least partially around the conductor. An external force upon the switch will cause the flexible conductor to flex toward the contact, and if the force is sufficient, the conductor will electrically interconnect with the contact. When the conductor connects with the contact, a signal is provided to the indicator.

The indicator comprises a light source such as a three volt, light-emitting diode. When the conductor interconnects with the contact, a circuit, which includes a power source (a battery), closes to cause the diode to illuminate. Thus, when an athlete hits a sporting implement (such as a tennis racket with a tennis ball), the impact will cause the flexible conductor to flex and interconnect with the contact, thus causing the indicator to illuminate and provide a visual indication of where in the swing the athlete strikes the ball.

A sensitivity control is provided to allow adjustments for use of the device for various sports, for various aspects of a given sport, and for players with various physical attributes. If the player is experienced with a strong forehand but a weak overhead shot, for example, various adjustments can be made to the device to ensure proper indications to the player. The sensitivity control comprises the contact mounted on adjustable pinchers to allow for repositioning thereof along the length of the conductor. Additionally, the sensitivity control may include additional adjustments to allow the contact to come closer to or farther from the flexible conductor. In effect, the two adjustments, singularly or in conjunction with each other, change the distance from the conductor to the contact. Sensitivity may also be adjusted by weighting an end of the conductor. Therefore, different amounts of impact force are required to illuminate the indicator and various sensitivity adjustments are provided.

The sensing device may be installed as an integral component with a sporting implement or may be adapted for removable attachment to various sporting implements. By installing brackets on the sensing device, it may be attached to various rackets such as tennis, squash or racquetball, or it may be attached to a baseball bat, a golf club, or etc.

It is a technical advantage of the present invention that a relatively simple circuit is provided to give a visual indication to an athlete during training. It is a further technical advantage of the present invention that adjustment means are provided to change the sensitivity of a device for various uses by the athlete. It is a still further technical advantage that the present invention is adapted for removable attachment to various sporting implements.

BRIEF DESCRIPTION OF THE DRAWINGS

For a more complete understanding of the invention and for further advantages thereof, reference is now made to the following Detailed Description taken in conjunction with the accompanying Drawings in which:

FIG. 4 is a cross-sectional view of the device of FIG. 2 along the lines 4—4;

FIG. 5 is a cross-sectional view of the device of FIG. 2 along the lines 5—5;

FIG. 6 is a cross-sectional view of the device of FIG. 6 along the lines 6—6.

DETAILED DESCRIPTION OF THE PREFERRED EMBODIMENT

Figure 1:
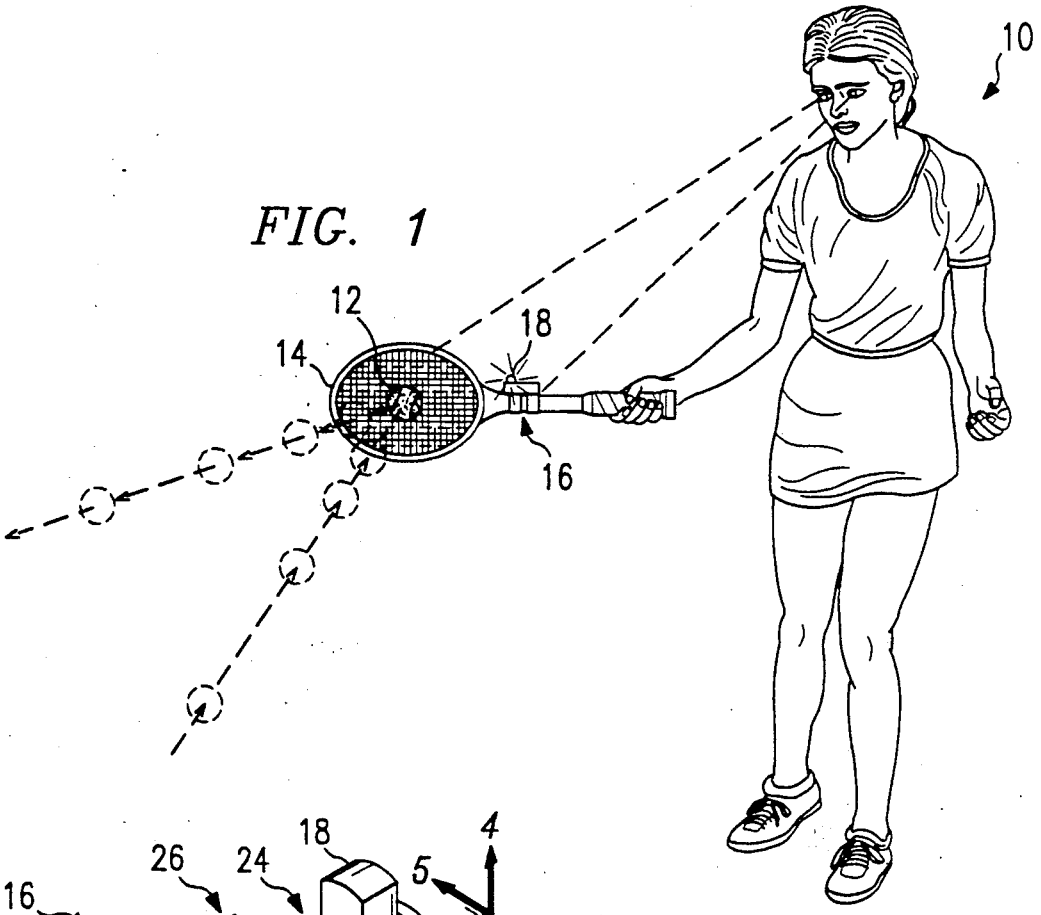
FIG. 1 is a perspective view of a device constructed in accordance with the present invention installed on a tennis racket.

In FIGS. 1-7, like items are identified by like and corresponding numerals for ease of reference. Referring first to FIG. 1, a tennis player 10 has just hit a tennis ball 12 with a tennis racket 14 in a forehand stroke. Fixed to the racket 14 is a relatively simple and light-weight device generally identified by the reference numeral 16 constructed in accordance with the present invention. The device 16 includes an indicator 18 which provides a visual display to allow the tennis player 10 to know where in the stroke the ball 12 has been hit by the racket 14. Thus, depending upon the type of stroke (forehand, backhand, or overhead) the player 10 will know exactly where in the stroke that the ball 12 was hit. This will allow the player 10 to know whether the stroke was hurried, delayed or on target. Additionally, the device 16 can indicate to the player whether the "sweet spot" of the racket 14 hit the ball 12.

Figure 2:
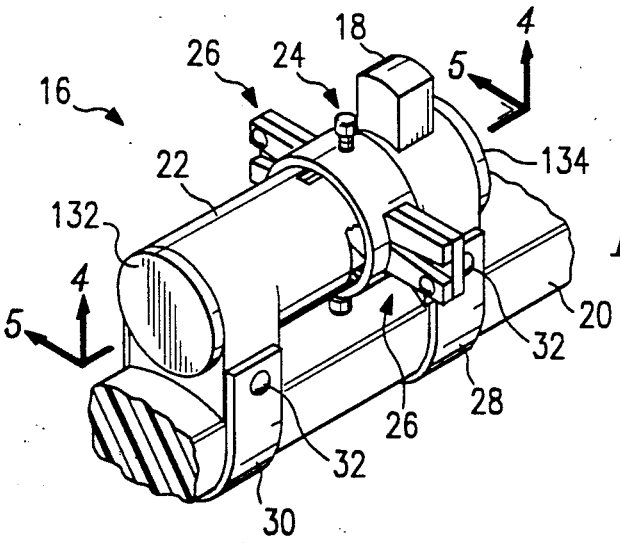
FIG. 2 is a more detailed perspective view of the device of FIG. 1.

Referring to FIG. 2, a perspective view of the device 16 is shown attached to a shaft 20 of a sporting implement such as a tennis racket. The device 16 comprises the indicator 18, a generally cylindrical container 22, first adjustment 24 and second adjustment 26. The device 16 may be fixed to the shaft 20 by brackets 28 and 30 which are designed to fit around the shaft 20 and be securely held thereon by screws 32. It is to be understood, although not shown, that the device 16 may be integrally installed in a sporting implement such as by placing the device 16 within the hollow shaft of a tennis racket.

Figure 3:
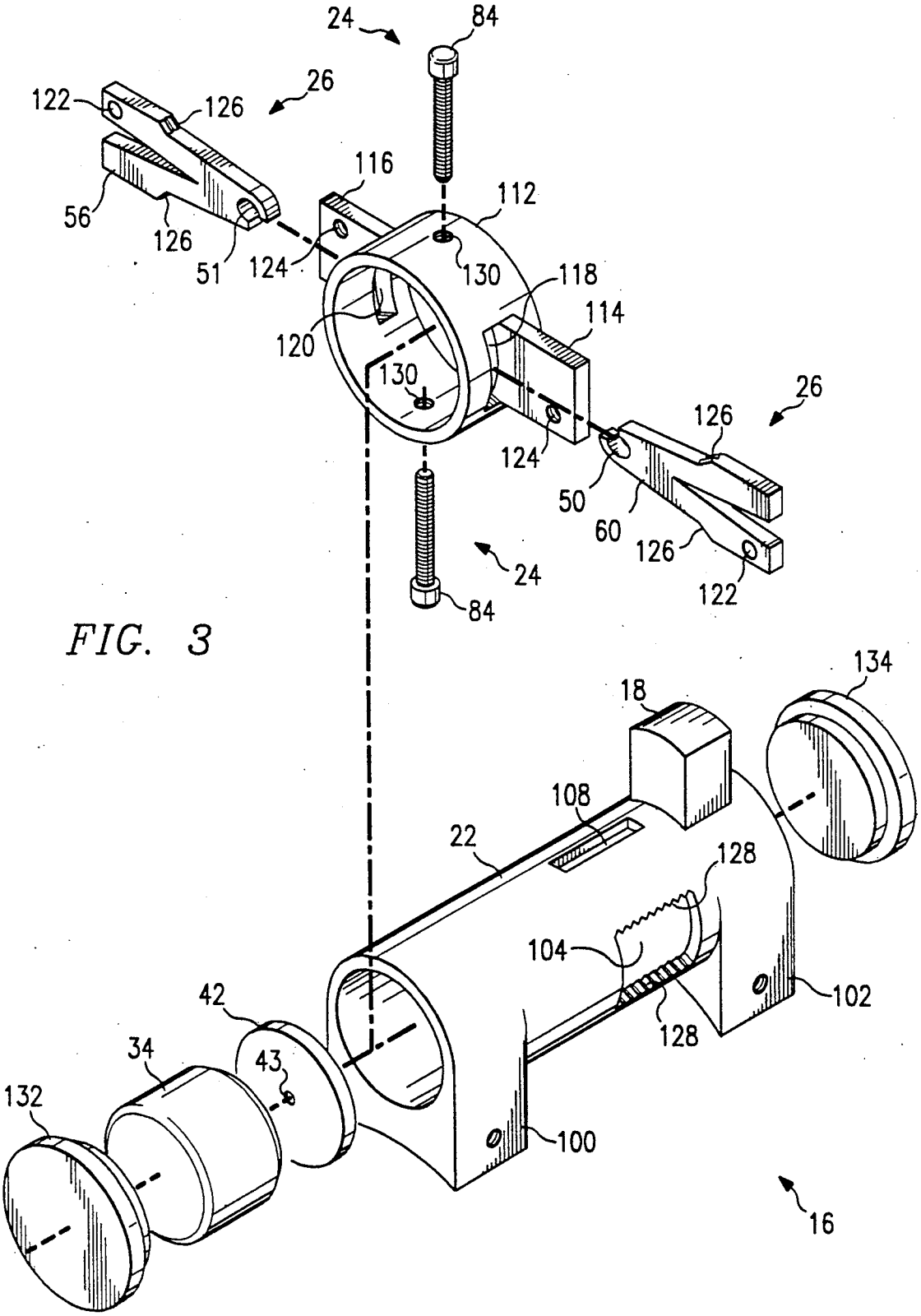
FIG. 3 is an exploded perspective view of the device of FIG. 2.

Referring to FIG. 3, an exploded perspective of the device 16 is shown. The generally cylindrical container 22 is formed with an integral support 100 and an attachable support 102 for use with the brackets 20 and 30 as previously described above. Windows 104, 106, 108 and 110 (only window 104 shown in FIG. 3) are formed through the container 22 to allow the adjustments 24 and 26 to pass therethrough. Prior to the attachment (by any appropriate method such as bonding) of the support 102, a slide ring 112 is positioned over the container 22. The slide ring 112 comprises attachment ears 114 and 116 (only 114 shown in FIG. 3) and slots 118-120. Contact supports 54 and 56 of the second adjustment 26 pass through slots 118-120, respectively, and are secured to the ears 114-116 by any appropriate method such as screws 58 (see FIG. 4) through holes 122 and 124.

The contact supports 54 and 56 have a pincher or a scissors-like shape and are adapted for movement within the windows 104 and 106. Serrations 126 on the contact supports 54-56 match with serrations 128 on the windows 104 and 106. As can be readily understood, to adjust the adjustment 26, the contact supports 54 and 56 are pinched to separate the serrations 126 from the serrations 128. The adjustment 26 may then slide relative to the container 22 to change the sensitivity of the device 16, as will be subsequently described in greater detail.

The adjustment 24 comprises screws 84 which are threaded through appropriately threaded holes 130 (see FIG. 6) in the slide ring 112. The screws 84 then pass through the windows 108 and 110 (see FIG. 6) in the container 22 to allow movement with the ring 112 when the adjustment 26 is used. To adjust sensitivity with adjustment 24, the screws 84 are turned to press against contacts 50 and 51 on the supports 54 and 56 respectively, as will be subsequently described in greater detail.

Within the container 22, a separation piece 42 is positioned to separate a power source 34 from the contact 50. A hole 43 passes through the piece 42 to allow interconnection of the power source 34 and a wire 40 (see FIGS. 4 and 6). End caps 132 and 134 are interconnected to seal the container 22 by any appropriate method. For example, cap 132 may be snap fitted or threaded onto the container 22 to allow the power source 34 to be replaced, while the cap 134 may be bonded to the container 22 such as with an adhesive.

Referring to FIG. 4, a cross-sectional view of the device 16 along the lines 4—4 of FIG. 2 is shown. The indicator 18 (see FIG. 2) may be any appropriate device such as, for example, a 3 volt, light-emitting diode. The device 16 is provided with the power source 34 which may be, for example, a 3 volt lithium battery.

The device 16 generally comprises the cylinder 22 of any appropriate non-conductive material. The cylinder 22 is separated into a first chamber 36 and a second chamber 38 by the separation piece 42. Within the chamber 38 is a flexible conducting wire 40 which is secured to and passes through the separation piece 42. The wire 40 is sufficiently flexible to allow movement thereof about the attachment point 44 through the separation piece 42 as a result of a force impacting the device 16. The wire 40 may be provided with a weighted end 46 of various shapes opposite the attachment point 44 to assist in the flexing of the wire 40, as will be subsequently described in greater detail. The interior walls of the chamber 38 are spaced from the contacts 50 and 51 (see FIG. 5) so that the end 46 will strike the walls before over stressing and causing the wire 40 to break. The wire 40 is interconnected to the power source 34 at end 48 thereof.

Encircling the wire 40 are the contacts 50 and 51 which are designed to form a closed circuit with the power source 34, the indicator 18 and the wire 40 upon electrical interconnection with the wire 40. Thus, upon impact of a sporting implement with a playing object, the device 16 will undergo a force causing the wire 40 to flex and therefore oscillate back and forth between the contacts 50 and 51. Upon sufficient flexure, the wire 40 will make electrical interconnection with the contact 50 and/or 51 to momentarily close the circuit and provide power from the power source 34 to momentarily illuminate the indicator 18. Based upon the flexibility of the wire 40, the shape of the weight 46, the spacing between the contacts 50 and 51, the location of the contacts 50 and 51 along the length of the wire 40 and the spacing of the walls of the chamber 38 from the contacts 50 and 51, the indicator 18 will be illuminated. As the wire 40 oscillates between interconnections with the contacts 50 and 51, the indicator 18 will appear to be constantly illuminated whereas in reality it is a rapid series of on and off flashes.

The sensitivity adjustment 26 comprises the supports 54 and 56 which slide as indicated by arrows 52 within the windows 104 and 106 in the container 22 as a result of pinching the supports 54 and 56. By moving the contacts 50 and 51 relative to the wire 40 with the adjustment 26, the sensitivity of the device 16 is changed for a given force due to the wire 40 flexing about the point 44. As can be seen in FIG. 4, the supports 54 and 56 are arranged in an over-and-under configuration and, therefore, contacts 50 and 51 slide relative to each other. Although not shown, it is to be understood that there can be any number of supports, for example, four, forming the contacts around the wire 40. In addition, the contacts may be arranged to provide gaps therebetween so as to prevent closing of the circuit as a result of oscillation of the wire 40 in response to a force from a specific direction.

Figure 7:
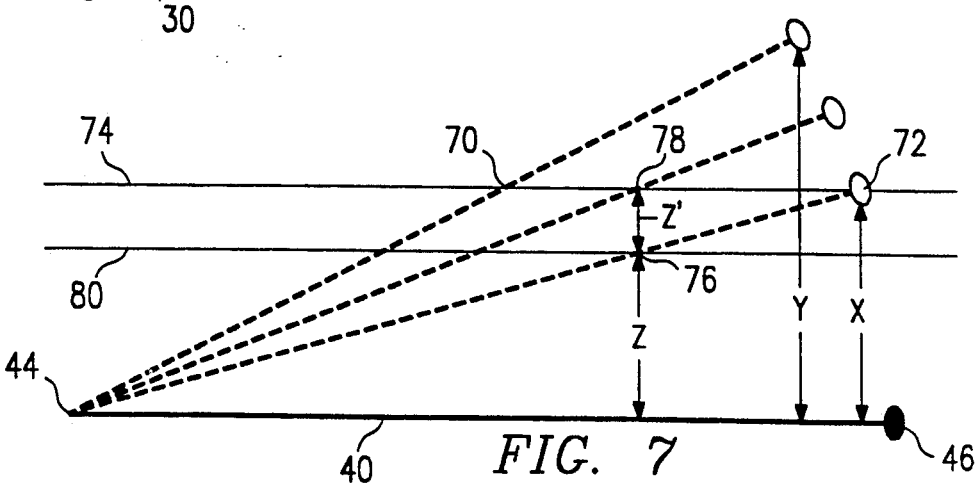
FIG. 7 is an illustrative example of the adjustments of the present invention.

Referring to FIG. 7, it can be seen that the distance the wire 40 must travel becomes less as, for example, the contact 50 approaches weighted end 46. Therefore, the closer the contact 50 is to the weighted end 46, the less force is required to make an electrical interconnection with the wire 40. As the contact 50 moves away from the weighted end 46, a greater force is required to flex the wire 40 sufficiently to interconnect with the contact 50.

By comparing two randomly selected points 70 and 72 on line 74 (representing the contact 50), the various force requirements can be illustrated for two different adjustments. When the contact 50 is positioned proximate the weighted end 46, the wire 40 must flex sufficiently to move the end 46 a distance X to interconnect the wire 40 with the contact 50 (interconnection therebetween indicated by the point 72). However, when the contact 50 is moved away from the end 46 toward the point 44, the end 46 must move a distance Y (greater than the distance X) for the wire 40 to interconnect with the contact 50 (indicated by the point 70). Thus it is apparent that a greater force is required to oscillate the wire 40 to cause repeated interconnection between the wire 40 and the contact 50 as the contact 50 moves away from the end 46.

Referring again to FIG. 4, the power source 34 is interconnected to the contact 50 and the indicator 18 by an electrical connector 60. The indicator 18 is also interconnected to the contact 51 and the power source 34 through an electrical connector 62. Until the wire 40 interconnects with the contact 50 or 51, the device 16 is an open circuit. Once interconnection between the wire 40 and the contact 50 or 51 is achieved, a closed circuit occurs from the wire 40 to the contact 50 or 51 to the power source 48, and to the indicator 18.

Referring to FIG. 5, a cross-sectional view of the device 16 along the line 5—5 of FIG. 2 is shown. In FIG. 5, the sensitivity adjustment 24 is particularly illustrated. The adjustment 24 comprises adjustment screws 84 that abut the contacts 50 and 51. By turning the screws 84, the contacts 50 and 51 are brought closer to or farther away from the wire 40. As the contacts 50 and 51 are brought closer to the wire 40 by the screws 84, less force is required to make an electrical interconnection therebetween.

Referring to FIG. 7, the various force requirements for two different adjustments of the contact 50 by the adjustment screw 84 are illustrated. Two adjustments are indicated by the line 74 and a line 80. When the contact 50 is in the position indicated by the line 80, the wire 40 will interconnect with the contact 50 at a point 76 after travelling a distance Z. However, when the contact 50 is moved to a position indicated by the line 74, the wire 40 must travel a distance $Z+Z'$ to interconnect therewith at a point 78. It is therefore apparent that a greater force is required to cause interconnection between the wire 40 and the contact 50 as the contact 50 is moved away from the wire 40. Thus, by moving the contact 50 (and 51) closer to or farther from the wire 40, the sensitivity of the device 16 may be adjusted.

Referring to FIG. 6, a cross-sectional view along the lines 6—6 of FIG. 5 is shown. The contacts 50 and 51 surround the wire 40 in a generally oval shape rather than a circle to provide further sensitivity variations for different directions of a force. For example, if the device 16 is installed on a tennis racket the force used to hit a forehand shot may be less than the force used to hit an overhead shot. Thus it is possible to arrange the contacts 50 and 51 to interconnect with the oscillating wire 40 in response to different forces in different directions. Additionally, the shape of the weighted end 46 may be correspondingly varied to provide similar directional sensitivities. Thus, if the end 46 is an ellipsoid, the effect will be greater sensitivity along the major axis than along the minor axis. A twisting factor may also enter into the sensitivity adjustment by the use of an irregularly shaped weighted end 46. Obviously, other shapes may be chosen to provide the desired directional sensitivity.

In operation, the device 16 is installed upon a sporting implement such as a tennis racket. The device 16 is then adjusted using the first and second adjustments 24 and 26 depending upon the use thereof and upon the physical characteristics of the individual. It can be appreciated that different sensitivities are preferred for baseball versus tennis, males versus females, forehand strokes versus backhand strokes, and etc. Thus, the device 16 is capable of being individually customized by the user. Additionally, the device 16 can be adjusted to provide indication of hitting the "sweet spot" on a tennis racket. Due to the nature of its construction, a tennis racket vibrates less when the "sweet spot" is hit than it does if another portion of the "face" is hit. Therefore, by properly adjusting the device 16, when the "sweet spot" is hit, the wire 40 will oscillate less and the indicator 18 will only flash on momentarily, whereas if another spot on the racket is hit, the wire 40 will oscillate for a longer period of time and the indicator 18 will stay illuminated longer due to the increased vibration of the racket.

Although the present invention has been described with respect to a specific preferred embodiment thereof, various changes and modifications may be suggested to one skilled in the art. It is intended that the present invention encompass such changes and modifications as fall within the scope of the appended claims.

I claim:

1. An adjustable impact indicating device for a sporting implement, comprising:

switch means for detecting an impact on an implement, said switch means comprising a length of a flexible conductor and adjustable contact means for making contact with the conductor and positioned substantially about said conductor, wherein said flexible conductor will flex to electrically contact said contact means in a range of sporting implement orientations upon an impact;

means responsive to said switch means for indicating the occurrence of said impact to a user; and means for selectively adjusting the impact sensitivity of said switch means, including means for selectively adjusting the distance between said contact means and said flexible conductor.

2. The device of claim 1, wherein said means for indicating comprises a light source.

3. The device in claim 2, wherein said light source comprises a light-emitting diode.

4. The device of claim 1, wherein said means for adjusting further comprises:

means for sliding said contact means relative to said length of said conductor.

5. The device of claim 1, wherein said contact means comprises at least two arcuate contact members, said contact members being selectively positionable closer to or further away from said flexible conductor.

6. An adjustable impact indicating device for a sporting implement, comprising:

switch means for detecting an impact on the implement, said switch means comprising a length of a flexible conductor and contact means for making contact with the conductor and positioned at least partially about said conductor, wherein said conductor will flex upon an impact to electrically contact said contact means in multiple orientations of said sporting implement;

means responsive to said switch means for visually indicating the occurrence of said impact to a user;

means for sliding said contact means relative to said length of said flexible conductor; and means for moving said contact means closer to or farther from said flexible conductor.

7. The device of claim 1, wherein said means for adjusting comprises:

a shaped weight attached to an end of said conductor, wherein sensitivity varies according to the shape of said weight.

8. The device of claim 1, wherein said means for adjusting comprises:

said contact having a preselected shape, wherein said conductor is spaced at various distances from said contact.

9. The device of claim 8, wherein said preselected shape comprises an oval in cross-section.

10. The device of claim 1, further comprising:

a chamber enclosing said switch means, wherein the walls of said chamber are disposed to limit flexure of said flexible conductor after contact between said flexible conductor and said contact means.

11. The device of claim 1, further including means for mounting the device to a sporting implement.

12. The device of claim 11, wherein said means for mounting comprises a bracket fixed to the device, said bracket adapted for removable attachment to an implement.

13. The device of claim 1, further including a power source integral with the device.

14. A sporting implement, impact indicating device, comprising:

switch means for detecting an impact on a sporting implement, said switch means comprising a length of a flexible conductor and a contact means for making contact with the conductor and adjustably positioned about a substantial portion of said conductor, wherein said conductor will flex to electrically contact said contact means in a substantial range of orientations of a sporting implement;

a light-emitting diode responsive to said switch means for indicating the time of said impact;

an integral power supply; and a bracket for removably attaching the device to a sporting implement.

15. The device of claim 14, wherein said power supply comprises a lithium battery.

16. The device of claim 14, wherein said flexible conductor is fixed at a first end and able to flex in an oscillating manner at a second end, wherein said conductor flexes in corresponding relation to an impact; and wherein said contact means is spaced apart from and substantially around said conductor for electrical interconnection to said conductor when said conductive flexes in response to an impact.

17. The device of claim 16, further comprising means for adjusting sensitivity of said switch means.

18. The device of claim 17, wherein said means for adjusting comprises:

first adjustment means for sliding said contact between said first end and said second end of said conductor; and second adjustment means for moving said contact closer to or farther from said conductor.

19. The device of claim 17, wherein said means for adjusting comprises:

a shaped weight attached to said flexible conductor at said second end.

20. The device of claim 14, wherein said means for removably attaching comprises a bracket.

* * * * *